US006948200B2

(12) United States Patent
Wyman

(10) Patent No.: US 6,948,200 B2
(45) Date of Patent: Sep. 27, 2005

(54) CHILD'S FOOT BAG BLANKET

(76) Inventor: Loran Lewis Wyman, 2830 Audubon Cir., Davis, CA (US) 95616

( * ) Notice: Subject to any disclaimer, the term of this patent is extended or adjusted under 35 U.S.C. 154(b) by 0 days.

(21) Appl. No.: 10/712,604

(22) Filed: Nov. 12, 2003

(65) Prior Publication Data

US 2005/0097671 A1 May 12, 2005

(51) Int. Cl.[7] ..... A41B 13/06
(52) U.S. Cl. ..... 5/494; 5/416; 2/69.5; 297/184.13
(58) Field of Search ..... 5/416, 494; 2/69.5, 2/83; 296/81; 297/184.13

(56) References Cited

U.S. PATENT DOCUMENTS 3,962,738 A * 6/1976 Menditto ..... 5/494
5,046,204 A * 9/1991 Mohler ..... 5/413 R
5,243,724 A * 9/1993 Barnes ..... 5/482
5,283,909 A * 2/1994 Hill ..... 2/69
5,722,094 A 3/1998 Ruefer
5,727,255 A 3/1998 Minks
5,950,261 A 9/1999 Hay et al.
5,956,766 A 9/1999 Benway
5,970,542 A 10/1999 Mays
6,105,168 A * 8/2000 Hazen ..... 2/69.5
6,219,847 B1 4/2001 Aikins
D448,914 S 10/2001 Caudill
6,393,612 B1 5/2002 Thach et al.
6,408,439 B1 6/2002 Garforth-Crippen
6,643,870 B2 * 11/2003 Bertrand ..... 5/482

* cited by examiner

*Primary Examiner*—Michael Trettel

(57) ABSTRACT

A blanket to wrap around a user in a sitting or semi-prone position, the blanket including a lower portion and a top portion, the lower portion having a pouch to cover feet and legs of the user and the top portion to wrap around the user.

20 Claims, 5 Drawing Sheets

CHILD'S FOOT BAG BLANKET

FIELD OF THE INVENTION

The present invention relates generally to a blanket and, more particularly, to a wrap-around blanket having a pocket compartment or pouch for feet and lower legs, the blanket particularly adapted for use by a child seated in a jogging stroller, bike trailer, walking stroller or child car seat.

BACKGROUND OF THE INVENTION

Parents often place their children into baby joggers, bike trailers, walking strollers and car seats for transport, exercise and outdoor enjoyment, even in cold weather. A blanket will keep the child sufficiently warm, however, blankets often fall off the child during movement or get kicked off by wiggling a child. A challenge existed between needing to keep a child warm, and wanting to allow for perceived full leg movement, leg crossing and easy entry and exit from the blanket.

Some blankets form pockets that encompass a user from the feet to the torso. Such full-pocket blankets are difficult to apply to a sitting child and may also irritate the child. To apply a full-pocket blanket, for example, a parent first places the child into a car seat. Next, the parent pulls the rim of the full-pocket blanket up over the feet and up around the exposed legs. Once the parent reaches the point where the child's legs meet the car seat, the parent lifts the child's legs and buttocks and simultaneously pulls the rim of the full-pocket blanket up towards and around the child's waist.

As a result of the height of the flu-pocket, the parent is forced to lift a majority of the weight of the child, which may potentially cause back injury to the parent and may agitate or awaken a resting child. Additionally, a child's skin may be irritated and a rash may develop on a child's leg or lower back where the child's leg meets the rim of the pocket. The irritation may be caused by the weight and movement of the child pressing against the discontinuity between the seat and the rim or edge of the blanket. Further, the full-pocket blanket may bind and clump resulting in discomfort to a child's leg or back.

It is an object of the present invention to provide a blanket, which may be used on a user in a baby jogger, bike trailer, walking stroller or car seat that provides warmth, allows ease of application and removal, and provides extensive freedom of movement for a seated user. It is a further object of the invention to provide a blanket having minimal leg restrictions. It is still a further object of the invention to provide a blanket that is intuitive to use and may be applied and removed easily and quickly.

Further objects will become apparent from the drawings and the following description and claims.

SUMMARY OF THE INVENTION

Disadvantages and problems associated with previously developed blankets have been substantially reduced or eliminated with various embodiments of the present invention.

This invention relates to a blanket structure having a lower bottom portion and a top portion. The bottom portion provides warmth and forms a roomy low-rim pocket or pouch for both feet and lower legs. The pouch allows for easy mobility of a child's lower extremities. The top portion is wide and open so that it may be wrapped around a child. In some embodiments of the present invention, fasteners at one or more corners or edges of the top portion allow the blanket to be held wrapped around the child. The blanket may be easily applied to the child to provide warmth and comfort, and subsequently may be easily removed.

Some embodiments of the present invention are adapted with a pass-through opening to be used in conjunction with a harnessing device of a child seat restraint system, such as found in various baby joggers, bike trailers, walking strollers and children's car seats. The blanket includes a small opening to allow part of a safety harness of a five-point system or a three-point system to pass through the blanket.

Accordingly, it is apparent that the invention may be manufactured in various sizes to accommodate an individual child's dimensions. The dimensions may be set for children of various sizes and ages, including infants, toddlers and young children. Alternatively, dimensions may be set for an adult user. Additionally, the invention may be manufactured using a variety of materials and colors.

From the figures and the following descriptions and claims, important technical advantages of the present invention are readily apparent to one skilled in the art.

BRIEF DESCRIPTION OF THE DRAWINGS

Embodiments of the invention may be understood by referring to the following description and accompanying drawings.

DETAILED DESCRIPTION

Embodiments for the present invention and their advantages are best understood by referring to FIGS. 1 through 6 of the drawings. Like numerals are used for like and corresponding parts in the various drawings. The blanket of the present invention provides a practical alternative to conventional blankets used for outside child-involved activities where conventional blankets often fall off or inadequately retain heat around a child's torso, legs and feet.

Figure 1:
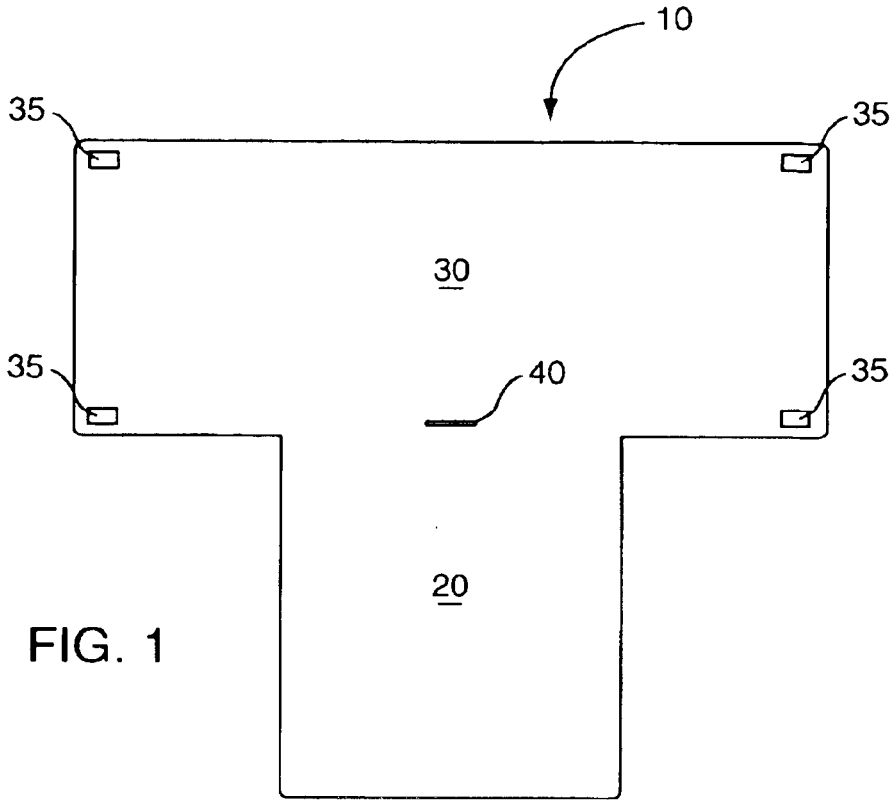
FIG. 1 shows a front view of a blanket in an opened position according to some embodiments of the present invention.

FIG. 1 shows a front view of a blanket 10 in an opened position according to some embodiments of the present invention. The blanket 10 has a bottom portion 20 and a top portion 30. The combined height of the bottom portion 20 and top portion 30 may be set cover the front of the child, including feet, legs, hips and torso. The bottom portion 20 defines a pouch 25 (as seen from a back view of the blanket) that is deep enough to enclose a child's feet and legs. The height of the pouch 25 is adapted to cover a child up to the child's thighs but not enough not to extend to the child's mid-thighs and buttocks. The width of the pouch 25 is wide enough to allow for perceived unrestrained and free movement of a child's legs.

In some embodiments for a blanket 10 adapted to a 6–18 month old child, the bottom portion 20 has a height of approximately 12 inches and a width of approximately 14 inches, or more generally, a height between approximately 8–14 inches and a width between approximately 10–16 inches. In a blanket 10 adapted to a 18–36 month old child, the bottom portion 20 has a height of approximately 18 inches and a width of approximately 18 inches, or more generally, a height between approximately 16–26 inches and a width between approximately 16–24 inches. In a blanket 10 adapted to a 3–5 year old child, the bottom portion 20 has a height of approximately 22 inches and a width of approximately 32 inches, or more generally, a height between approximately 24–36 inches and a width between approximately 26–36 inches.

Unlike full-pocket blankets cover, the pouch 25 of the blanket 10 does not extent past mid-thigh of the user. Since the blanket 10 does not extend past the mid-thigh, it is unnecessary for a parent to lift the weight of the child when applying the blanket 10. A parent simply extends the legs or slightly lifts the legs to apply the blanket 10. The application of blanket 10, therefore, becomes much faster, easier and more intuitive than application of full-pocket blankets that require substantial lifting. It is less likely that the child using the blanket 10 will suffer from the disadvantages of full-pocket blankets, such as jostling during application, and binding and rashing due to the excess height of a full-pocket.

Still another advantage of the blanket 10 over full-pocket blankets is the perceived freedom of movement a child notices. Since the pouch 25 of bottom portion 20 extents to a point set somewhere between the back of the calves and just to the edge of the seat, the blanket 10 does not extend to a point between the child and the seat. Therefore, the pouch 25 does not unnecessarily hold down or hold back the child's legs. Additionally, the rim of the pouch 25 of the blanket 10 is not in a position to bind or clump between seat and child's body, thus reducing discomfort and potential rashing.

The top portion 30 forms the portion of the blanket 10 that wraps around a torso. The top portion 30 is generally rectangular in shape and may have rounded corners. Alternatively the top portion 30 and bottom portion 20 are often constructed with the same continuous pieces of material without a joint or seam dividing them.

The upper portion 30 of the blanket is wide enough so that, in a closed position, the left-hand and right-hand sides overlap. Typically, the top portion 30 is at least twice as wide as the bottom portion 20. For example, a blanket with a bottom portion 20 approximately 14 inches wide may have a top portion that is approximately 30 inches wide. A broad width allows the blanket to have sufficient overlap to define flaps so when wrapped around a child, the left-hand flap and the right-hand flap may be fastened to each other thereby providing heat retention. The height of the top portion of the blanket may be designed to cover just a child's torso and not the child's shoulders. The designed height of top portion 30 may set such that the blanket 10 wraps about the child to just underneath armpits. Alternatively, the designed height of the top portion 30 may be lengthened so that the blanket 10 will wrap around the torso, shoulders and arms of a child.

Yet another advantage of the blanket 10 is that heat retention qualities of the blanket may be changed. The top portion 30 of the blanket 10 may be partially folded or rolled such that the blanket 10 wraps around the child to a height anywhere along the torso down to the waist thereby aiding in regulating temperature. Therefore, the height of the top portion 30 may be designed to reach the armpits or may be designed to cover the arms and shoulders, and may be rolled down and wrapped around the child such that a majority of the torso is uncovered by the blanket 10.

In some embodiments for a blanket 10 adapted to a 6–18 month old child, the top portion 30 has a height of approximately 10 inches and a width of approximately 30 inches, or more generally, a height between approximately 8–14 inches and a width between approximately 28–36 inches. In a blanket 10 adapted to a 18–36 month old child, the top portion 30 has a height of approximately 14 inches and a width of approximately 42 inches, or more generally, a height between approximately 14–18 inches and a width between approximately 40–46 inches. In a blanket 10 adapted to a 3–5 year old child, the top portion 30 has a height of approximately 16 inches and a width of approximately 44 inches, or more generally, a height between approximately 14–20 inches and a width between approximately 42–60 inches.

The top portion 30 may be positioned centered over the bottom portion such that the blanket 10 is symmetrical and the left and right flaps have approximately equivalent lengths that are used to wrap around and overlap behind the user. Alternatively, the top portion 30 may be position skewed to the bottom portion 20. In such designs, one flap is shortened while the other similarly lengthened, thereby shifting the position in which to two flaps overlap. In some embodiments, the top portion 30 has a single flap that wraps all the way around the child. For example, the side edge of one of the flaps may be aligned with the side edge of the bottom portion 20 creating an inverted-L appearance from an opened front view.

The blanket 10 and a child's upper weather wear, such as a jacket, sweater, sweatshirt or coat, work in tandem to maximize warmth retention and minimize cold leakage into child's cocoon thereby properly regulate temperature. On cold days if the top portion 30 of the blanket 10 is rolled down to wrap around the child's waist, the blanket 10 extends the warmth already provided by a child's jacket. On colder days, the blanket 10 may be unrolled and extended to wrap around a zipped-up jacket for more heat retention. Alternatively, if too warm for a zipped-up jacket but too cold for an open jacket, the top portion 30 of the blanket 10 may be wrapped around to cover the open jacket thereby still assisting in keeping the child's body warm while allowing ample movement of a child's appendages.

In other embodiments, fasteners are used to connect the left and right flaps. A VELCRO® hook and loop type material may be used as a fastener. Alternatively, other fasteners, such as buttons, snaps, hooks, zippers or other self-latching material or structures, may be used. The fastener may be located near the edges or corners of the left-hand and right-hand sides of the upper portion. For example, a VELCRO® hook or loop type material may be placed on the inside of one flap and the other of the hook or loop type material may be placed on the outside of the other flap, thereby when one flap is folded over and pressed against the other flap, the blanket will be held closed behind the child's back.

Some embodiments include a pass-through opening 40 for a three-point (T-strap) safety harness or a five-point safety harness. A single pass-through opening 40 (e.g., a horizontal shaped slit) in the blanket 10 accommodates the center strap of a harness thereby allowing the remaining straps of the harness to be placed over the blanket. Advantageously, to insert the center strap, it is not necessary to move and lift a child's legs. A parent simply inserts the center strap through the opening 40 then continues to apply the blanket 10. Once the blanket 10 is wrapped around the child, the parent finishes connecting the harness in the usual manner.

Figure 2:
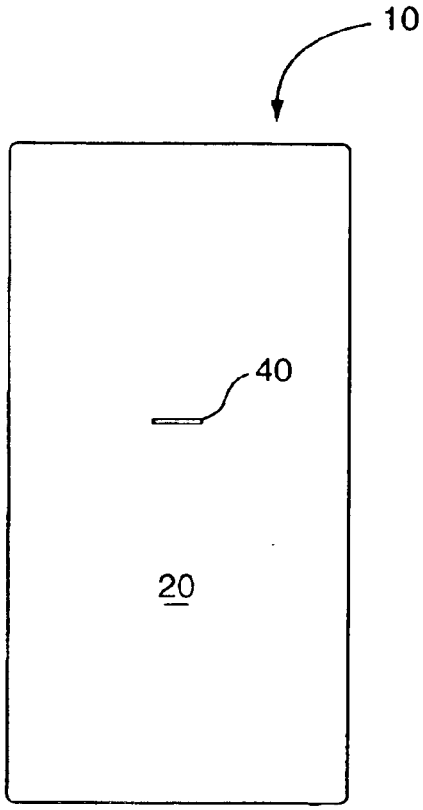
FIG. 2 shows a front view of a blanket in a closed position according to some embodiments of the present invention.

FIG. 2 shows a front view of a blanket 10 in a closed position according to some embodiments of the present invention. When the blanket 10 is in a closed position, the blanket 10 is wrapped around the child with the left and right-hand flaps behind the child.

Figure 3:
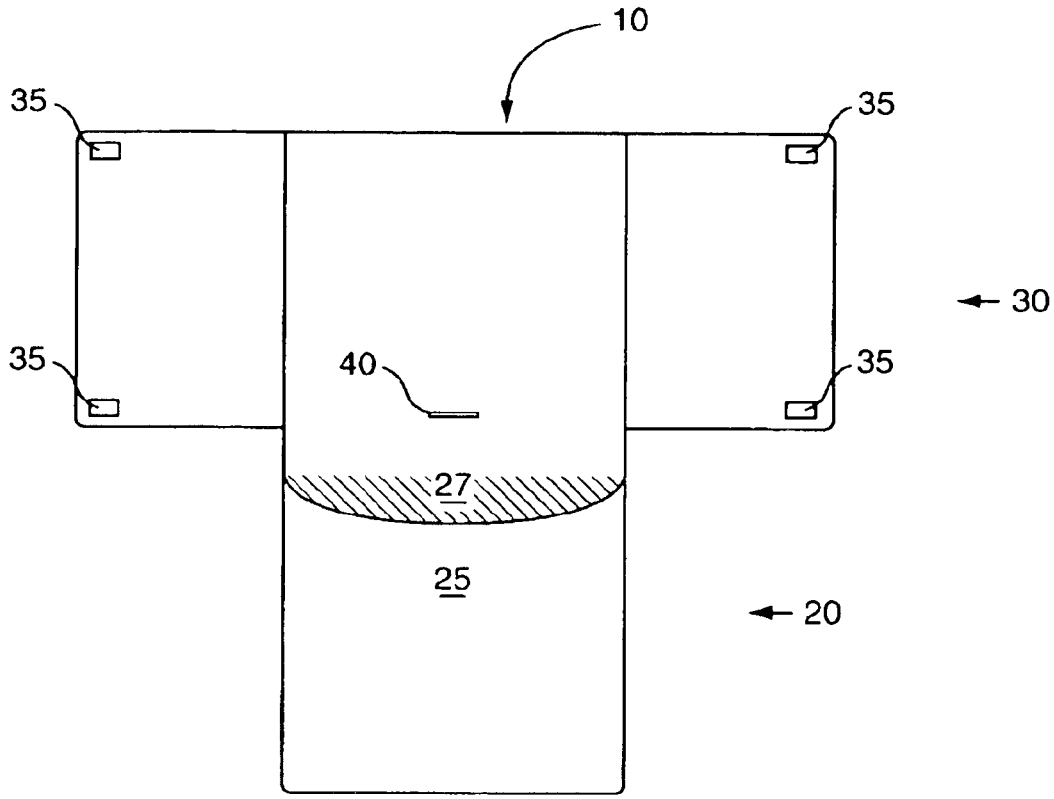
FIG. 3 shows a back view of a blanket having side flaps in an opened position according to some embodiments of the present invention.

FIG. 3 shows a back view of a blanket 10 in an opened position showing side flaps open according to some embodiments of the present invention. The figure shows the back or inside of the blanket 10 with the side flaps open as the blanket would look prior to use. The bottom portion 20 of the blanket 10 defines a pouch 25 for a child's feet and legs. The top rim of the pouch 25 may be positioned at the intersection of the top 30 and bottom 20 portions. Alternatively, the rim may start at some distance below the top portion 30, thereby defining a strip 27. In some embodiments, a strip 27 on the bottom portion 20 separates the pouch 25 from the top portion 30. In some embodiments, the height of the strip 27 is approximately 1–2 inches tall, or more generally may range from 0–6 inches for a child's foot bag blanket 10.

The pouch 25 may be formed using two separate pieces of material joined along the left, bottom and right edges. Alternatively, the foot space may be formed by folding a blanket material over a horizontal axis then stitching or otherwise joining the side edges together. Alternatively, the foot space may be formed by folding a blanket material over a vertical axis then stitching the open edges to form the pouch 25. Stitching, (e.g., buttonhole stitching) ensures the child's feet and legs are positioned within the warmth of the blanket when the blanket is used.

Figure 4:
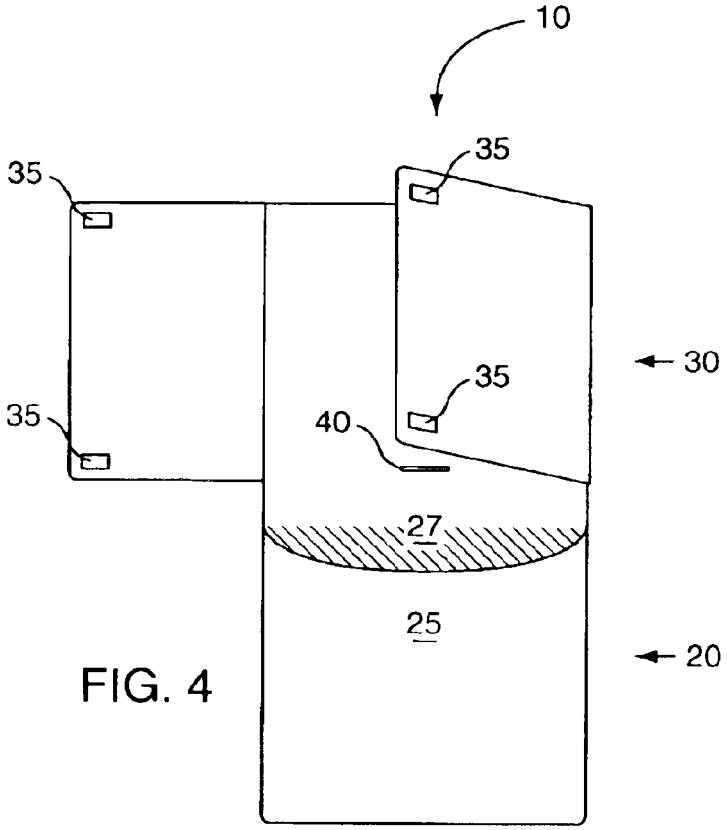
FIG. 4 shows a back view of a blanket having one side flap in an opened position and another side flap in a wrapped position according to some embodiments of the present invention.

FIG. 4 shows a back view of a blanket 10 in a transition state between opened and closed according to some embodiments of the present invention. The figure shows the back of the blanket 10 with one side flap open and a second side flap in a wrapped position as the blanket 10 would look as it is applied to a child.

Figure 5:
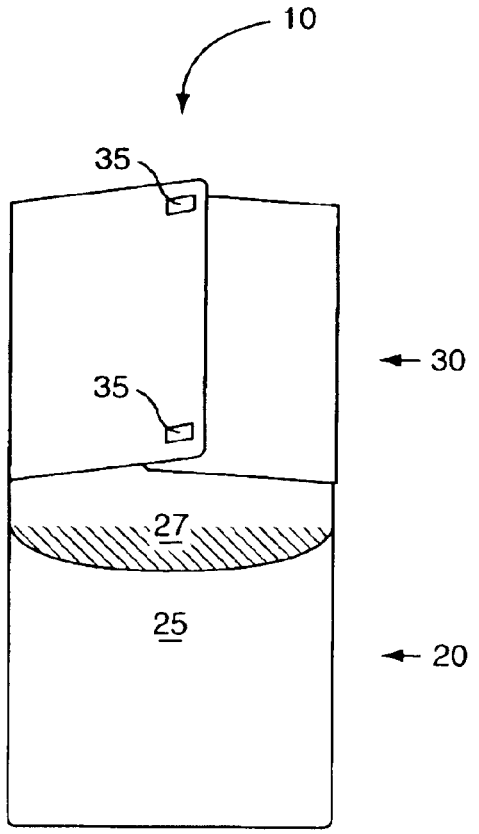
FIG. 5 shows a back view of a blanket with side flaps closed according to some embodiments of the present invention.

FIG. 5 shows a back view of a blanket 10 with side flaps closed according to some embodiments of the present invention.

Figure 6:
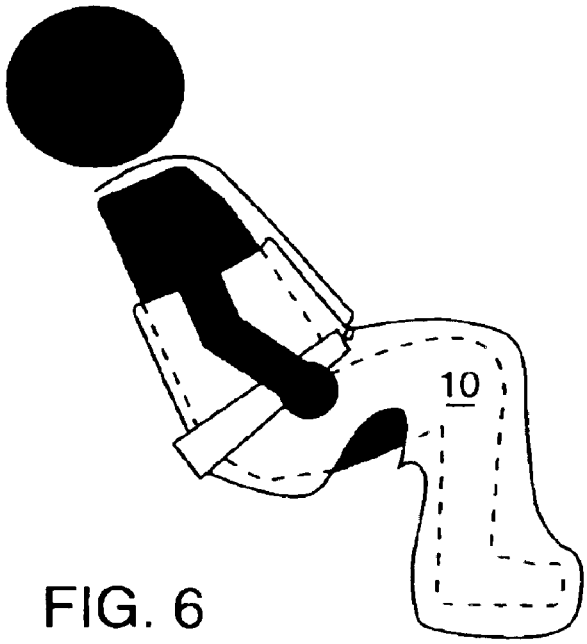
FIG. 6 shows the application of a blanket to a child, securely covering the child's feet, lower legs and torso according to some embodiments of the present invention.

FIG. 6 shows the application of a blanket 10 to a child, securely covering the child's feet and body according to some embodiments of the present invention.

The figures show the utility of the blanket and advantage for warmth, product security and body coverage when placed on and around a child. The pouch 25 allows for full foot and leg movement, leg crossing, knee bending and shoe wearing while providing warmth from the bottom of the feet all the way up to the child's torso where the blanket 10 covers the child's upper torso and can be wrapped around or tucked underneath a jacket or sweatshirt. The top portion 30 of the blanket 10 allows for secure, but not excessively tight body coverage.

To apply the blanket 10 to a seated child, a parent simply slides the child's feet and legs into the pouch 25. After the child's feet and legs are placed in the pouch 25, the parent leans the child slightly forward and wraps the flaps of the top portion 30 around the back of the child. The top portion 30 is placed on the child's chest. The left and right-hand flaps are wrapped around the back of the child and, in some embodiments, held in place simply by the pressure of the child against the seat and friction. Alternatively, fasteners 35 may be connected to secure the left and right-hand flaps to each other. Advantageously, since the pouch 25 is not used to cover the child above the legs, it is not necessary to lift the child out of the seat.

Figure 7:
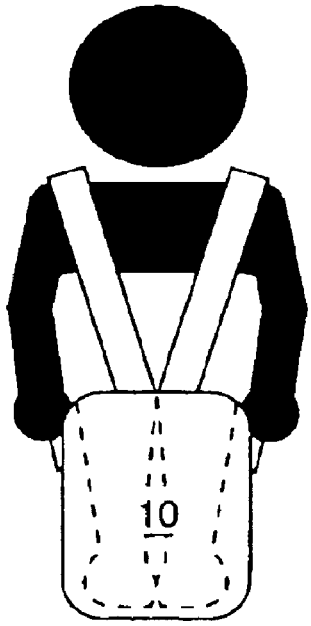
FIG. 7 shows the use of a blanket with a child seated in a seat having a five-point harness safety system in place according to some embodiments of the present invention.

FIG. 7 shows the use of a blanket 10 with a child seated in a seat having a five-point harness safety system in place according to some embodiments of the present invention. When a child is in a seat with a safety harnessing mechanism, the parent may first secure the child in the safety harnessing, and second slide the child's feet and legs into the pouch 25. The side flaps may be tucked into each of the sides between the child and seat without worry of interfering with the safety harnessing system.

Alternatively, the parent may slip the child's feet and legs into the pouch 25 of the blanket 10 and rest the top portion 30 of the blanket 10 on the child's chest. Next, the parent slips the center harness through the opening 40 and then wraps the child with the flaps. The remainder of the harnessing system may then be applied over the blanket 10. As another advantage, if the blanket 10 is wrapped under the child's armpits, the blanket does not restrain the child's arm movements.

In some embodiments, the blanket 10 may have other accessories. The blanket 10 may include a flat-pocket, which may be used for holding toys or other items. One or more flat-pockets may be incorporated on to the face of the top portion 30 on the outside or on the inside of the blanket 10. The blanket 10 may include a cup-pocket, which may be used to hold a sippy-cup or the like. The blanket 10 may include a secure loop for attaching a tethered object such as a toy or a pacifier. By tethering an object to a secure loop on the blanket 10, a child will be able to reach the tether of a dropped object to regain possession of the object. Additionally, tethered objects are not throw-able from the child's seat. Additionally, the blanket 10 may include a bib area, which may be incorporated on to the face of the top portion 30.

Figure 8:
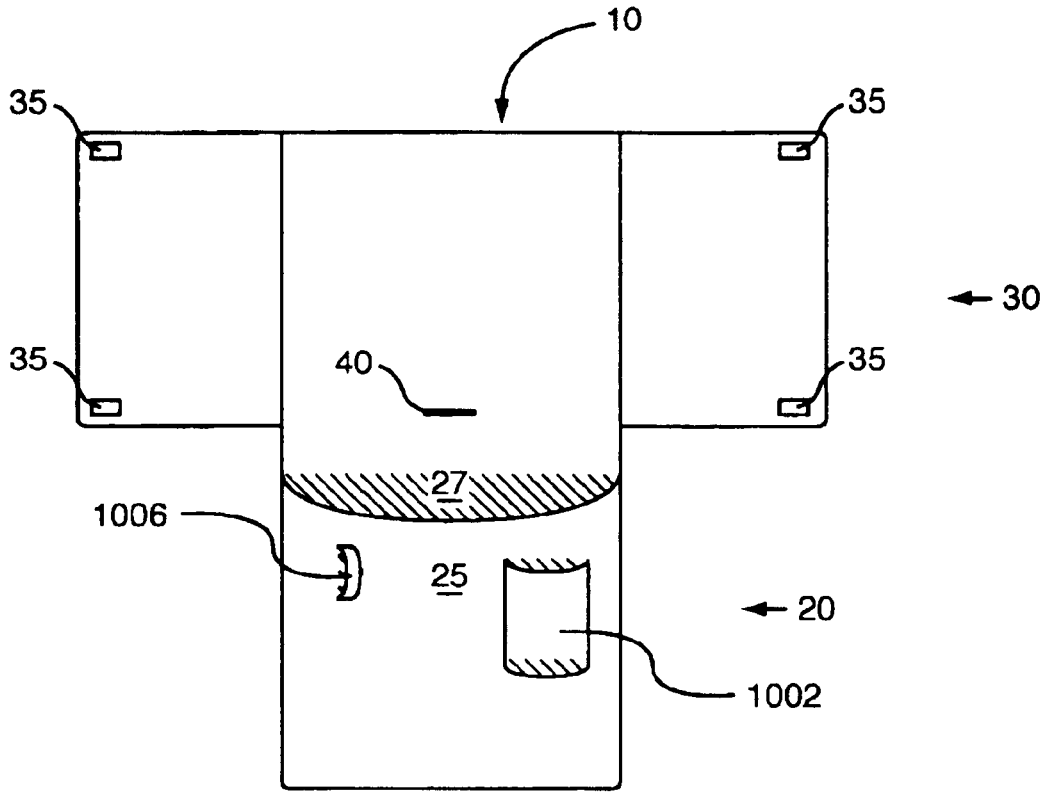
FIG. 8 shows a blanket having a various accessories according to some embodiments of the present invention.

FIG. 8 shows a blanket 10 having various accessories according to some embodiments of the present invention. On the front of the blanket 10 is a fiat-pocket 1002. The flat-pocket may be formed simply by stitching or otherwise attaching a pocket shaped piece of material to a face of the blanket 10. Unlike other blankets that do not have an orientation, the blanket 10 of the current invention has an orientation that may be used to guarantee an opening of a pocket is always facing upwards. Additionally, the flat-pocket 1002 may have a closing mechanism, such as a hook and loop type material, a zipper, a button, a snap, elastic or the like.

On the front side of the blanket 10 may also include a cup-pocket. The cup-pocket is designed to hold a child's cup. Also shown is a security loop 1006 attached to the blanket 10. The security loop 1006 is security attached to the blanket such that a child's tugging and pulling will not cause the loop 1006 to separate from the rest of the blanket 10. The security loop may also be used for hanging the blanket 10 for drying after the blanket 10 is washed. A blanket may also include a bib on the front of the blanket 10. An incorporated bib 1008 aids in protecting any clothe material of the blanket 10 from direct food and drink spillage.

Although the description above contains many specifics and various arrangements, these should not be construed as limiting the scope of the invention but as merely providing illustrations of some of the embodiments of this invention. For example, the blanket 10 may be made from of any number of weights of fleece, plush fabrics or other warm or waterproof material commonly used in manufacturing blankets and coverings and providing a variety of levels of warmth and rain protection to serve a variety of climates and weather conditions. The blanket 10 may be formed with one or more layers of fabric to enhance durability, comfort and warmth retention. The exposed inside and outside surfaces of the blanket 10 may have different colors or patterns. For example, the inside surface, which makes contact with the user's body may be a solid dark color, and the outside surface, which is still partially viewable to the user and others, may me a bright pattern or print. Additionally, the blanket 10 may be manufactured in a variety of sizes to accommodate a variety of ages and sizes of infants, children and adults.

Accordingly, any foreseeable variations and modifications that may occur to those skilled in the art and not precluded by prior art are to be considered within the scope and spirit of the invention as defined by the appended claims.

What is claimed is:

1. A blanket comprising:

a lower portion, wherein the lower portion forms a single pouch having a single top opening configured far receiving a pair of feet; and an upper portion, wherein the upper portion includes a back portion, a left-hand side flap, a right-hand side flap, and one or more fasteners, the left-hand side flap connected to the back portion and the right-hand side flap connected to an opposite end of the back portion, wherein the one or more fasteners are fixed to one or more of the left-hand side and right-hand side flaps, and wherein the upper portion defines a width and a height wherein the width is greater than the height; and wherein the back portion of the upper portion is attached to at least a portion of the top opening of the lower portion.

2. The blanket of claim 1, wherein the lower portion and the upper portion comprise a sheet of fabric material.

3. A blanket for a child, the blanket comprising:

a lower portion, wherein the lower portion forms a single pouch having a single top opening configured for receiving a pair of feet of the child; and an upper portion defining a center portion, a left-hand side flap to the left of the center portion, a right-hand side flap to the right of the center portion, wherein:

the upper portion includes one or more first-half fasteners on the left-band side flap and one or more corresponding second-half fasteners on the right-hand side flap;

the first-half fasteners and the corresponding second-half fasters are configured to temporarily fasten together the left-hand side flap and right-hand side flap when the blanked is in a closed position; and wherein the upper portion defines a width and a height wherein the width is greater than the height; and wherein the center portion of the upper portion is attached along at least a portion of the top opening of the lower portion.

4. The blanket of claim 3, wherein the lower portion and the upper portion comprise a sheet of fabric material.

5. The blanket of claim 3, wherein:

the height of the upper portion is approximately 8 to 14 inches;

the width of the upper portion is approximately 28 to 36 inches;

the lower portion has a height of approximately 8 to 14 inches; and the lower portion has a width of approximately 10 to 16 inches.

6. The blanket of claim 5, wherein:

the height of the upper portion is approximately 10 inches;

the width of the upper portion is approximately 30 inches;

the height of the lower portion is approximately 12 inches; and the width of the lower portion is approximately 14 inches.

7. The blanket of claim 3, wherein:

the height of the upper portion is approximately 14 to 18 inches;

the width of the upper portion is approximately 40 to 46 inches;

the lower portion has a height of approximately 16 to 26 inches; and the lower portion has a width of approximately 16 to 24 inches.

8. The blanket of claim 7, wherein:

the height of the upper portion is approximately 14 inches;

the width of the upper portion is approximately 42 inches;

the height of the lower portion is approximately 18 inches; and the width of the lower portion is approximately 18 inches.

9. The blanket of claim 3, wherein:

the height of the upper portion is approximately 14 to 20 inches;

the width of the upper portion is approximately 42 to 60 inches;

the lower portion has a height of approximately 24 to 36 inches; and the lower portion has a width of approximately 26 to 36 inches.

10. The blanket of claim 9, wherein:

the height of the upper portion is approximately 16 inches;

the width of the upper portion is approximately 44 inches;

the height of the lower portion is approximately 22 inches; and the width of the lower portion is approximately 32 inches.

11. The blanket of claim 3, wherein the first-half fasteners and the corresponding second-half fasters comprise a hook striping and a corresponding loop striping.

12. The blanket of claim 3, wherein the upper portion further defines a small opening to allow part of a safety harness of a multi-point child seat restraint system to pass through the small opening.

13. The blanket of claim 3, wherein the upper portion further includes a cup-pocket sized for a child's cup.

14. The blanket of claim 3, wherein the upper portion further includes a secure loop.

15. The blanket of claim 3, wherein the upper portion further includes a flat-pocket.

16. A blanket for a child, the blanket comprising:

a lower portion, wherein the lower portion forms a pouch having a top opening configured for receiving a pair of feet of the child;

a strip portion; and an upper portion defining a center portion, a left-hand side flap to the left of the center portion, a right-hand side flap to the right of the center portion, wherein:

the upper portion includes one or more first-half fasteners on the left-hand side flap and one or more corresponding second-half fasteners on the right-hand side flap; and the first-half fasteners and the corresponding second-half fasters are configured to temporarily fasten together the left-hand side flap and right-hand side flap when the blanked is in a closed position; and wherein a top edge of the strip portion joins along a bottom edge of the center portion of the upper portion;

wherein a bottom edge of the strip portion joins along a portion of the top opening of the lower portion;

wherein the lower portion, the strip portion and the upper portion comprise a sheet of fabric material;

wherein the upper portion has a height of approximately 14 to 18 inches;

wherein the upper portion has a width of approximately 40 to 46 inches;

wherein the strip portion has a height of approximately 1 to 4 inches;

wherein the strip portion has a width of approximately 14 to 18 inches;

wherein the lower portion has a height of approximately 16 to 26 inches;

wherein the lower portion has a width of approximately 16 to 24 inches;

wherein the first-half fasteners and the corresponding second-half fasters include a hook striping and a corresponding loop striping; and wherein the upper portion further defines a small opening to allow part of a safety harness of a multi-point child seat restraint system to pass through the small opening.

17. The blanket of claim 16, wherein:

the height of the upper portion is approximately 14 inches;

the width of the upper portion is approximately 42 inches;

the height of the strip portion is approximately 2 inches;

the width of the strip portion is approximately 16 inches;

the height of the lower portion is approximately 18 inches; and the width of the lower portion is approximately 18 inches.

18. The blanket of claim 16, wherein the upper portion further includes a cup-pocket sized for a child's cup.

19. The blanket of claim 16, wherein the upper portion further includes a secure loop.

20. The blanket of claim 16, wherein the upper portion further includes a flat-pocket.

* * * * *